United States Patent [19]

Chen et al.

[11] Patent Number: 4,627,911

[45] Date of Patent: Dec. 9, 1986

[54] DISPERSED CATALYST CRACKING WITH METHANOL AS A COREACTANT

[75] Inventors: Nai Y. Chen, Titusville, N.J.; Thomas F. Degnan, Jr., Yardley, Pa.

[73] Assignee: Mobil Oil Corporation, New York, N.Y.

[21] Appl. No.: 815,660

[22] Filed: Dec. 30, 1985

Related U.S. Application Data

[63] Continuation-in-part of Ser. No. 767,666, Aug. 21, 1985, abandoned, which is a continuation of Ser. No. 622,818, Jun. 21, 1984, abandoned.

[51] Int. Cl.[4] ..... C10G 11/05; C10G 47/16; C07C 1/24

[52] U.S. Cl. ..... 208/120; 208/111; 585/358; 585/408; 585/640; 585/733

[58] Field of Search ..... 208/111, 120; 585/358, 585/408, 640, 733

[56] References Cited

U.S. PATENT DOCUMENTS 3,254,023 5/1966 Miale et al. ..... 208/120
3,530,064 9/1970 Chen et al. ..... 208/113
4,035,285 7/1977 Owen et al. ..... 208/120
4,090,949 5/1978 Owen et al. ..... 208/78
4,431,519 2/1984 LaPierre et al. ..... 208/111

*Primary Examiner*—Brian E. Hearn
*Assistant Examiner*—O. Chaudhuri
*Attorney, Agent, or Firm*—A. J. McKillop; M. G. Gilman; L. G. Wise

[57] ABSTRACT

A catalytic cracking process is described in which methanol is a coreactant with gas oil in combination with a small amount (catalyst/oil 0.01) of a dispersed, very fine, and highly active catalyst powder, such as ZSM-5B. The methanol is preferably admixed with the catalyst before admixture with the oil in order to protect the catalyst from adsorption of poisonous compounds (e.g., nitrogenous compounds) during the initial stages of the reaction, particularly if the methanol is insoluble in a non-polar hydrocarbon feed. The premixed materials are fed into a riser reactor. The residence time in the reactor is 6–15 seconds. Preferably, the catalyst is not regenerated. The quantity of methanol is maintained so that its exothermic reaction is approximately heat balanced with the endothermic catalytic cracking reaction.

12 Claims, 6 Drawing Figures

DISPERSED CATALYST CRACKING WITH METHANOL AS A COREACTANT

This is a continuation-in-part of copending application Ser. No. 767,666, filed on Aug. 21, 1985, which in turn is a continuation of Ser. No. 622,818, filed June 21, 1984, both now abandoned.

BACKGROUND OF THE INVENTION

1. Field of the Invention

This invention relates to fluid catalytic cracking of a mixture of hydrocarbon oils and methanol in the presence of a dispersion of fine zeolite particles, exemplified by ZSM-5B. It further relates to heat balancing of the exothermic methanol reaction with the endothermic catalytic cracking reaction so that little or no addition of heat is required to maintain the catalytic reaction. It still further relates to use of a highly active catalyst, exemplified by ZSM-5B, in a very small quantity so that the catalyst is used on a once-through basis and regeneration thereof is obviated.

2. Review of the Prior Art

The use of zeolite catalysts based on rare-earth exchanged zeolites X and Y has become widely accepted by the petroleum industry for cracking gas oil to make gasoline and fuel oil. Most known or proposed processes which involve zeolite catalyzed hydrocarbon reactions utilize a fixed bed reactor with particles no smaller than 1/25th of an inch diameter or a fluidized bed of catalyst, as in FCC cracking, wherein the particle size ranges from about 1 to 140 microns with an average particle size of about 62 microns, and in all of these processes the reaction is conducted with a relatively large amount of catalyst in contact with the feed at any given instant.

A number of hydrocracking processes which have been developed involve the use of a hydrogen donor. U.S. Pat. No. 3,951,781 is an example thereof. It teaches admixing a hydrogen donor (e.g., $CH_3OH$, $C_2H_5OH$, ethers, and the like) with de-asphalted resid before fluid catalytic cracking at less than 200 psig, 1000° F., and 0.5–10 seconds. The ratio of methanol to hydrocarbon charge is within the range of 0.01–5 and preferably within about 0.05–0.30 on a stoichiometric weight basis but is varied as a function of the hydrogen deficiency of a raffinate obtained from solvent deasphalting a vacuum tower bottoms, the amount of sulfur, nitrogen, and oxygen in the raffinate, the amount of polycyclic aromatics, the catalytic composition employed, and the level of conversion desired. It is significant that it is preferred to avoid any considerable or significant excess of methanol with the charge because of methanol's tendency to react with itself under some conditions.

U.S. Pat. No. 3,974,063 provides another example of a hydrogen donor process. It teaches the conversion of nitrogen-containing oil stock, such as shale oil syn crudes, by cracking in the presence of $C_2$–$C_5$ hydrocarbons and/or methanol with an acidic zeolite cracking catalyst. Co-cracking of the high nitrogen stock with the carbon-hydrogen contributors provides appreciable denitrogenation of the charge, thus decreasing the need for further hydroprocessing. The desired chemical reactions are particularly promoted by a mixture of large and small pore crystalline zeolites in the presence of hydrogen donor materials and under cracking conditions within the range of 900°–1100° F. (482°–593° C.), a hydrocarbon residence time of 0.5 seconds to about 5 minutes, and a faujasite and/or mordenite crystalline zeolite within the range of 2–15 wt. %, dispersed in a suitable matrix material. The fluid cracking pressure is generally less than 100 psig. The ratio of methanol to hydrocarbon in the charge is within the range of from about 0.01 to about 5 and preferably within the range of about 0.05 to about 0.30 on a stoichiometric weight basis.

U.S Pat. No. 4,002,557 describes a process for mixing an $H_2$-rich, $H_2$-donor, or $H_2$-generating material, such as methanol, with gas oil, and then preheating, admixing with catalyst, and reacting in an FCC unit. It is preferred to avoid providing any considerable or significant excess of methanol with a charge because of its tendency to react with itself under some conditions.

U.S. Pat. No. 4,263,126 is directed to converting waxy or viscous hydrocarbon oils in order to lower the pour point or provide less viscous oils. Reactive dispersions of zeolites, such as HZSM-5, HZSM-11, HZSM-12, HZSM-23, HZSM-35, and HZSM-38, are used as an extremely fine powder having a particle size of less than 0.01 to about 5 microns. It is preferred to use the as-formed powder since this is convenient and least expensive if no separation or reuse of the particles is required. The reactive dispersion is heated at a temperature of about 200°–500° C. (392°–932° F.) for a time effective to induce conversion, usually from 0.1 to 72 hours.

U.S. Pat. No. 4,328,834 relates to the conversion of methanol, or a mixture of lower alcohols and related oxygenates such as ethers, aldehydes, and ketones, in the presence of a special type of zeolite catalyst maintained in an upflowing fluid condition and comprising a dispersed catalyst phase riser contact zone discharging into a more dense upflowing fluid mass of catalyst particles. The residence time in a riser contact zone is maintained at 1–10 seconds, and in the more dense phase within the range of 5 to 80 seconds. The catalyst concentration within a riser contact zone is 1–15 pounds per cubic foot and in the more dense catalyst bed phase is 20–40 pounds per cubic foot. Heat exchange means are provided to maintain the exothermic temperature rise to not more than about 195° F. (90° C.) while restricting the product outlet of the dense bed is restricted to within the range of 2–2.5 fluid bed of catalyst to below 800° F. (427° C.) and preferably not substantially above 765° F. (407° C.) while the reactor pressure at the bottom of the dense atmospheres. The catalyst is a zeolite having high silica-to-alumina mol ratios and high activity, even when the silica-to-alumina mol ratio exceeds 30.

Activity is generally defined in terms of an alpha value and is referred to as alpha activity which is an approximate indication of the catalytic activity of the catalyst compared to a standard catalyst. Alpha is the relative rate constant (rate of n-hexane conversion per unit volume of oxides, compositions per unit time). It is based on the activity of highly active silica-alumina cracking catalyst taken as alpha=1 (12.5% cracking at 5 minutes on stream). Alpha activity is further defined in U.S. Pat. No. 3,354,078 and the *Journal of Catalysis,* Vol. IV, pages 522–529, August 1965, incorporated herein by reference. The alpha scale is also described in an article published in *Journal of Catalysis,* Vol. VI, pages 278–287 (1966), incorporated herein by reference. The alpha scale so described will be used herein to define activity levels.

Generally, the ZSM-5 type zeolites are activated by calcining the zeolite at temperatures of about 550° C. to remove water and organic templates which are typically included in the zeolite forming solution. Calcination is achieved by heating the zeolite at the desired elevated temperature in air, hydrogen, or an inert gas such as nitrogen so that the desired activity is obtained. Typically, the heat treatment proceeds for at least 1 hour, although heating may last between 1–24 hours. The heat treatment is dry (no water) although up to 3% by weight of steam may be included in the calcining atmosphere.

It is known that catalytic cracking is an endothermic process which, at relatively high reaction rates, can become thermally self-quenching. Input of heat to fluid units occurs when the catalyst is regenerated by burning off coke to create maximum temperatures of about 1350° F. (730° C.), the hot catalyst being then recirculated for admixture with the incoming oil. Preferably, the catalyst is accompanied by particles of an inert and attrition-resistant material or is embedded in a matrix of such inert material which acts as a heat sink for transporting heat from the regenerator to the cracking unit.

Since the discovery of highly active zeolite cracking catalysts, the use of such zeolite crystals without the accompaniment of a large amount of inert materials has long been sought as a major improvement of the catalytic cracking process. However, it has been impractical to do so without a means of supplying heat to the reactor.

A reverse difficulty has arisen with highly exothermic reactions of Fischer-Tropsch synthesis, the oxo process, and oxygenate conversions. Attempts have been made to balance such exothermic and endothermic reactions by transferring heat within surface heat exchangers, but a method for achieving a more sensitive heat balance therebetween is needed.

SUMMARY OF THE INVENTION

Figure 1:
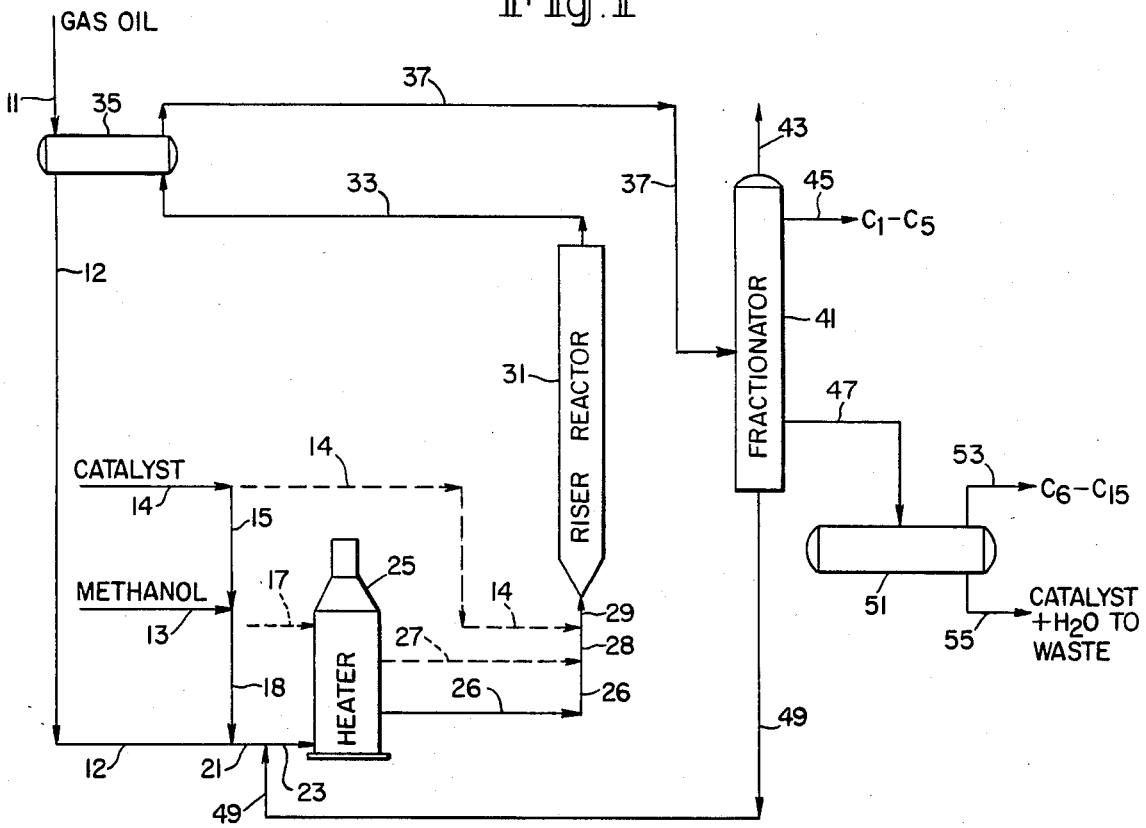
FIG. 1 is a schematic flow sheet for a catalytic heat balanced cracking/conversion process.

It is accordingly an object of this invention to provide a heat balancing process which employs zeolite crystals both for catalytic cracking of hydrocarbons and for catalytic oxygenate conversions.

It is further an object to utilize a highly active zeolite in finely divided form for such catalytic cracking and conversion reactions.

It is additionally an object to utilize a very small quantity of the zeolite, whereby regeneration of the catalyst is not necessary.

In accordance with these objectives and the principles of this invention, it has surprisingly been found that the exothermic heat of the methanol reaction over an acid catalyst offsets the cracking endotherm of the hydrocarbon oil, as measured by the average temperature of the process, and, importantly, that the nearness—indeed, the intimacy—of the two reactions effects minutely localized balancing of temperatures at the catalyst surfaces, as indicated by the small coke make, provided that the methanol is in the proper proportion to the oil. It is preferred that the catalyst be a zeolite in the as-made crystal form and finely subdivided, of very high acid activity (with, $\alpha$ at least 1600), and that the quantity of catalyst be very small in proportion to the oil (approximately 0.02 wt. % of the oil or at a ratio of catalyst/oil of less than 0.01).

It is highly preferred that the methanol be admixed with the catalyst before admission to the cracking unit and before admixture with the oil. This procedure has the benefit of protecting the catalyst from adsorption of poisonous compounds (e.g., nitrogenous compounds) during the initial stages of the reaction, particularly if the methanol is insoluble in the non-polar hydrocarbon feed.

Balancing the methanol exotherm against the hydrocarbon oil endotherm requires a heat balance within the catalytic cracker that is based upon the weight ratios of methanol to oil. Preferably, the weight ratios should be within the range of about 1:20 to about 2:1 of methanol:gas oil. More methanol may be used when the feed comes in at a temperature below the reaction temperature. This is based on the fact that each gram of methanol converted gives off 300–400 calories of heat and each gram of oil cracked absorbs 100–170 calories of heat.

Such a relationship enables the cracking reaction to be sustained substantially entirely by the highly exothermic conversion of methanol in the presence of a small concentration of high activity zeolite catalysts, whereby the cracking reaction is prevented from quenching itself thermally.

It has specifically been found that if a highly active zeolite catalyst, having an activity, alpha, of at least 1600, is used in a very highly divided state, such as a mean particle size of $3\times10^{-4}$ cm, it is possible to volatilize a hydrocarbon, such as a gas oil, and an oxygenate, such as methanol, and then to crack the gas oil while simultaneously converting the methanol at temperatures in the range of 450° to 650° C. during a reaction period of about 6 to about 15 seconds without having to add a significant amount of additional heat and without significant reduction of coke or of gas and while producing an increased quantity of lower-boiling and unsaturated hydrocarbons. The quantity of the catalyst can be up to about 5.0 wt. % and preferably is no more than 1.0 percent by weight and more preferably, no more than about 0.02% by weight of the gas oil. In consequence, the catalyst need not be regenerated because, at the 0.02% level, the quantity of catalyst consumed is about the same as that usually lost during regenerating operations.

DETAILED DESCRIPTION OF THE INVENTION

As shown in FIG. 1, the process of the invention comprises admixing a preheated hydrocarbon such as gas oil in line 12, a catalyst in line 14, an oxygenate such as methanol in line 13 to form a mixture in line 21 which additionally receives recycled hydrocarbons in line 49, to form a feed mixture in line 23 which enters heater 25. The feed mixture is heated in heater 25 to a temperature that is near to the reaction temperature, such as 500°–650° C. (932°–1202° F.), and is then sent through lines 26, 28, 29 to riser reactor 31, from which products, unreacted feed materials, and catalyst are withdrawn through line 33. The materials in line 33 are sent to a heat exchanger 35, in which the incoming gas oil in line 11 is preheated, and are fed through line 37 to a fractionator 41 from which various cuts are obtained, as indicated in FIG. 1. Gases such as $CO_2$ and CO are removed by discharge line 43, $C_1$–$C_5$ products are removed by discharge line 45, $C_6$–$C_{15}$ products and water are removed by line 47, and unreacted hydrocarbons, such as gas oil, are removed by bottom discharge line 49. The materials in line 47 are fed to decanter 51 from which $C_6$–$C_{15}$ products are discharged by line 53 and water and catalyst are discharged to waste disposal through line 55.

Riser reactor 31 is of conventional type except that there is no need for a cyclone separator section or a catalyst stripping section. The feed mixture in line 26 is heated to a temperature near to the reaction temperature before entering reactor 31, and the temperature within the reactor is controlled by balancing the ratio of methanol to gas oil in the feed mixture against the conversion level that is desired. By utilizing the process of this invention, reactor 31 has a built-in temperature control mechanism which is effective and automatic because the methanol conversion, which is exothermic, is always 100% complete, while the oil conversion, which is endothermic, is limited by the quantity of heat given off by the methanol conversion.

Heater 25, while being operated at the selected temperature, has sufficient capacity that feed materials in line 26 are always at this temperature. During conditions of high nitrogen content in the feed hydrocarbon, heater 25 may also be utilized for separately heating a mixture of oxygenate and catalyst which enters the heater through line 17. The separately heated oxygenate/catalyst mixture is fed to line 26 through line 27 and enters reactor 31 through lines 28, 29. In addition, the hydrocarbon and the oxygenate may be heated, as a mixture which moves through lines 21, 23, 26 or separately by moving through lines 21, 23, 26 for the hydrocarbon and through lines 17, 27 for the oxygenate, while catalyst is sent through line 14 to join line 28.

EXAMPLE 1

Cracking reactions were carried out in an isothermal empty plug flow reactor, using feeds of n-hexadecane containing 0.02 wt. % to 1.0 wt. % ZSM-5B powder.

Figure 2:
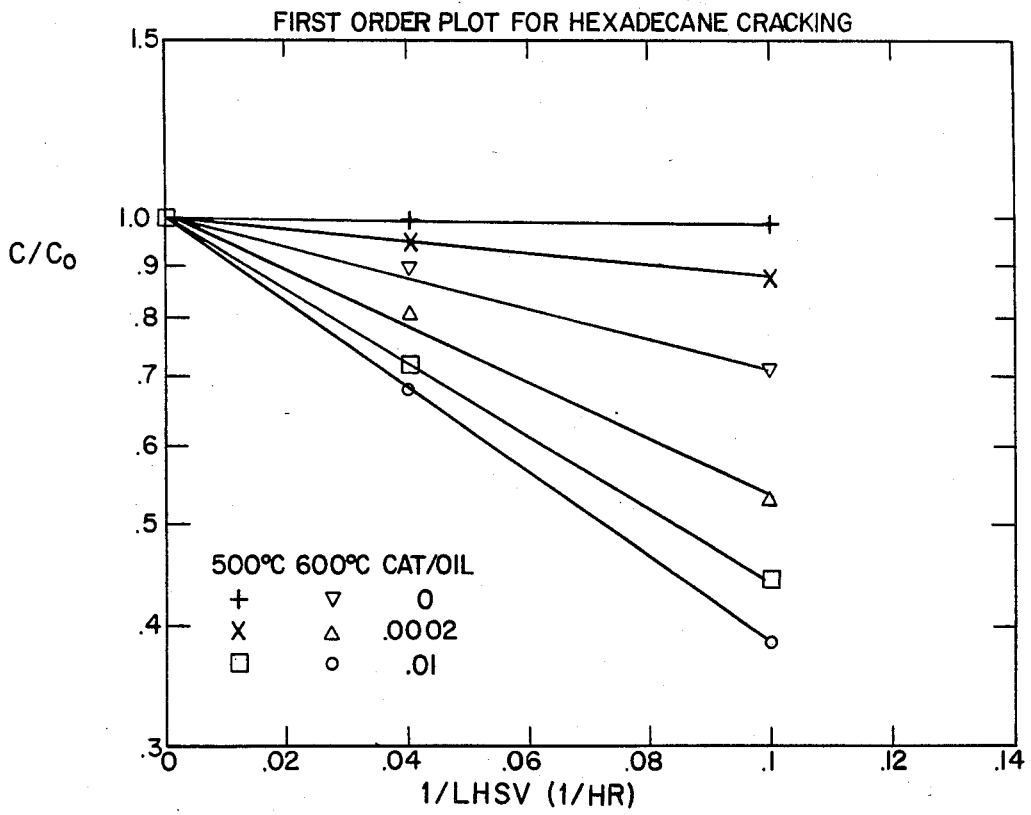
FIG. 2 is a graph showing first order relationships for hexadecane cracking.
Figure 3:
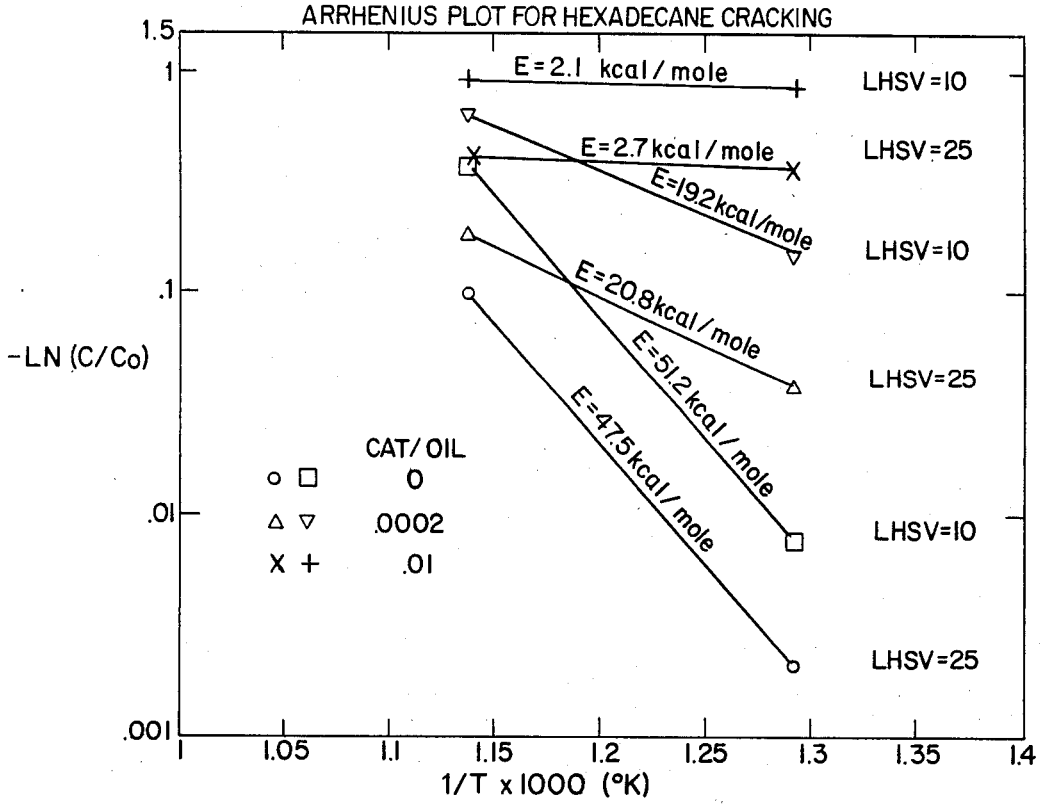
FIG. 3 is an Arrhenius plot for hexadecane cracking.

Tables 1 and 2 summarize the results from these hexadecane cracking runs. Being a pure compound, hexadecane should show a first-order cracking rate dependence on hydrocarbon concentration, regardless of whether the cracking proceeds by carbonium ion or by a free radical rate. Plots of ln (1-conversion) vs $LHSV^{-1}$, for several catalyst concentrations and two temperatures, are shown in FIG. 2 and confirm these first-order kinetics. Activation energies derived from these data are shown in FIG. 3.

TABLE 1

DISPERSED CATALYST CRACKING OF HEXADECANE OVER ZSM-5B CATALYST

| | 1 | 2 | 3 | 4 | 5 | 6 | 7 | 8 | 9 | 10 | 11 | 12 |
|---|---|---|---|---|---|---|---|---|---|---|---|---|
| LHSV, $hr^{-1}$ | 25 | 25 | 10 | 10 | 25 | 25 | 10 | 10 | 25 | 25 | 10 | 10 |
| Temperature, °C. | 498.9 | 600.6 | 500.3 | 601.1 | 499.4 | 599.7 | 497.8 | 610.1 | 498.9 | 606.1 | 496.7 | 602.2 |
| Feed Rate (cc/hr) | 100 | 100 | 40 | 40 | 100 | 100 | 40 | 40 | 100 | 100 | 40 | 40 |
| Catalyst-to-Oil Ratio ($\times 10^2$) | 1 | 1 | 1 | 1 | 0.02 | 0.02 | 0.02 | 0.02 | 0 | 0 | 0 | 0 |
| Net Liquid Fed (gms) | 43.7 | 55.5 | 37.3 | 23.2 | 32.2 | 51.9 | 19.6 | 30.2 | 47.9 | 18.5 | 52.0 | 9.1 |
| Net Liquid Out (gms) | 36.8 | 42.82 | 24.32 | 15.33 | 30.66 | 46.44 | 17.94 | 21.43 | 46.11 | 17.95 | 51.73 | 7.41 |
| Net Hexadecane in Prod. (gms) | 30.31 | 33.96 | 16.45 | 9.20 | 29.95 | 41.73 | 16.86 | 15.98 | 46.07 | 16.93 | 51.63 | 6.24 |
| Net Gas Out (gms) | 6.2 | 8.18 | 12.98 | 8.32 | 0.420 | 3.39 | 1.41 | 8.80 | 0.10 | 0.72 | 0.292 | 1.63 |
| Gas (cc) | 3400 | 4270 | 5300 | 4150 | 230 | 1900 | 540 | 670 | 100 | 490 | 180 | 1100 |
| % Liquid | 85.6 | 83.96 | 65.19 | 64.82 | 98.65 | 93.20 | 92.71 | 70.89 | 99.59 | 96.14 | 99.44 | 81.97 |
| % Gas | 14.4 | 16.04 | 35.18 | 34.81 | 1.35 | 6.80 | 7.29 | 29.11 | 0.41 | 3.86 | 0.56 | 18.03 |
| Analysis of Converted Liquid | | | | | | | | | | | | |
| 1BP–300° F. | 0.505 | 0.608 | 0.469 | 0.608 | 0.443 | 0.12 | 0.677 | 0.398 | 0.716 | 0.244 | 0.768 | 0.147 |
| 300–350° F. | 0.361 | 0.265 | 0.330 | 0.243 | 0.446 | 0.871 | 0.084 | 0.275 | 0.265 | 0.231 | 0.230 | 0.265 |
| 350–400° F. | 0.072 | 0.055 | 0.101 | 0.068 | 0.029 | 0.009 | 0.077 | 0.102 | 0.010 | 0.144 | 0.002 | 0.172 |
| 400–450° F. | 0.035 | 0.038 | 0.062 | 0.048 | 0.014 | 0 | 0.067 | 0.099 | 0.009 | 0.145 | 0 | 0.164 |
| 450–500° F. | 0.019 | 0.010 | 0.029 | 0.025 | 0.005 | 0 | 0.054 | 0.089 | 0 | 0.205 | 0 | 0.171 |
| 500–540° F. | 0.008 | 0.024 | 0.009 | 0.008 | 0.063 | 0 | 0.041 | 0.037 | 0 | 0.031 | 0 | 0.081 |
| Gas Analysis (wt. %) | | | | | | | | | | | | |
| Methane | 0.080 | 1.12 | 0.114 | 2.664 | 1.114 | 4.835 | 1.862 | 6.700 | 4.923 | 14.608 | 14.721 | 13.81 |
| Ethane + Ethylene | 1.99 | 4.98 | 3.72 | 18.01 | 6.18 | 23.50 | 9.63 | 37.38 | 21.45 | 52.38 | 46.45 | 52.10 |
| Propane | 25.39 | 11.98 | 20.69 | 13.59 | 17.65 | 7.79 | 11.60 | 3.48 | 16.53 | 4.05 | 7.26 | 3.29 |
| Propene | 24.86 | 21.31 | 31.79 | 46.62 | 43.11 | 36.87 | 44.50 | 37.56 | 37.93 | 19.79 | 23.56 | 21.37 |
| Isobutane | 7.59 | 3.31 | 3.96 | 1.90 | 3.35 | 0.75 | 2.21 | 0.28 | 1.074 | 0.133 | 0.25 | 0.15 |
| n-Butane | 17.35 | 11.50 | 9.66 | 4.21 | 8.71 | 3.41 | 4.67 | 0.98 | 5.17 | 0.736 | 1.20 | 0.69 |
| Other Butanes | 22.74 | 45.80 | 30.07 | 13.01 | 25.62 | 22.85 | 25.48 | 11.62 | 12.92 | 8.29 | 6.56 | 8.59 |
| $C_3H_8/CH_4$ (wt. basis) | 322.6 | 10.7 | 181.8 | 5.10 | 15.87 | 1.61 | 6.23 | 0.400 | 3.36 | 0.277 | 0.493 | 0.238 |
| i-$C_4$/n-$C_4$ | 0.438 | 0.287 | 0.411 | 0.450 | 0.394 | 0.219 | 0.473 | 0.282 | 0.209 | 0.180 | 0.208 | 0.218 |
| Conversion on Liquid (%) | 17.64 | 20.70 | 32.37 | 39.98 | 2.32 | 10.14 | 6.02 | 18.03 | 0.07 | 5.68 | 0.200 | 15.79 |
| Conversion Liq + Gas (%) | 29.50 | 33.42 | 55.91 | 61.10 | 3.66 | 16.94 | 13.31 | 47.14 | 0.21 | 9.54 | 0.760 | 30.97 |
| Gas/Liquid | 0.168 | 0.191 | 0.534 | 0.542 | 0.014 | 0.073 | 0.079 | 0.411 | 0.004 | 0.040 | 0.006 | 0.220 |
| Mass Balance | 0.984 | 0.919 | 1.001 | 1.010 | 0.965 | 0.964 | 0.999 | 1.000 | 0.967 | 1.009 | 1.000 | 1.016 |

TABLE 2

SUMMARY OF CRACKING DATA FOR REACTION OF HEXADECANE, METHANOL, AND HEXADECANE/METHANOL MIX OVER A ZSM-5 CATALYST DISPERSED IN THE FEED AT LHSV = 18.6 $HR^{-1}$

| Run No. | 13 | 14 | 15 | 16 | 17 | 18 | 19 | 20 | 21 | 22 | 23 | 24 |
|---|---|---|---|---|---|---|---|---|---|---|---|---|
| Feed | n-$C_{16}H_{34}$ | n-$C_{16}H_{34}$ | Mix* | MEOH | n-$C_{16}H_{34}$ | Mix* | n-$C_{16}H_{34}$ | n-$C_{16}H_{34}$ | Mix* | MEOH | n-$C_{16}H_{34}$ | Mix* |

TABLE 2-continued

SUMMARY OF CRACKING DATA FOR REACTION OF HEXADECANE, METHANOL, AND HEXADECANE/METHANOL MIX OVER A ZSM-5 CATALYST DISPERSED IN THE FEED AT LHSV = 18.6 $HR^{-1}$

| Run No. | 13 | 14 | 15 | 16 | 17 | 18 | 19 | 20 | 21 | 22 | 23 | 24 |
|---|---|---|---|---|---|---|---|---|---|---|---|---|
| Temperature, °F. | 1125 | 1125 | 1125 | 1125 | 1090 | 1090 | 970 | 970 | 970 | 970 | 900 | 900 |
| Temperature, °C. | 607 | 607 | 607 | 607 | 588 | 588 | 521 | 521 | 521 | 521 | 482 | 482 |
| Wt. % ZSM-5 | None | 1.0 | 1.0 | 1.0 | 1.0 | 1.0 | None | 1.0 | 1.0 | 1.0 | 1.0 | 1.0 |
| Wt. % Hexadecane | 100 | 100 | 80 | — | 100 | 80 | 100 | 100 | 80 | — | 100 | 80 |
| Wt. % Methanol | — | — | 20 | 100 | — | 20 | — | — | 20 | 100 | — | 20 |
| Total gms charged | 30.4 | 36.1 | 30.9 | 23.6 | 38.6 | 34.0 | 45.8 | 22.0 | 14.8 | 30.7 | 20.0 | 20.0 |
| Total gms recovered | 30.4 | 35.2 | 29.9 | 23.5 | 37.1 | 33.1 | 45.4 | 21.9 | 14.4 | 30.8 | 18.9 | 20.16 |
| Mass Balance | 100 | 97.5 | 96.8 | 99.6 | 96.1 | 97.4 | 99.2 | 99.5 | 97.3 | 99.7 | 95.0 | 100.2 |
| Product Analysis | | | | | | | | | | | | |
| Methanol | — | — | — | 45.97 | — | — | — | — | — | 82.50 | — | 10.16 |
| DME | — | — | 6.17 | 31.57 | — | 9.83 | — | — | 0.29 | 3.41 | — | 2.75 |
| CO | — | — | 0.27 | 5.61 | — | — | — | — | 0.05 | 2.47 | — | — |
| $CO_2$ | — | — | 0.54 | 1.24 | — | 0.43 | — | — | 0.20 | 0.94 | — | — |
| $H_2O$ | — | — | 8.12 | 13.50 | — | 6.82 | — | — | 10.94 | 4.94 | — | 4.46 |
| $CH_4$ | 0.19 | 0.17 | 0.81 | 0.69 | 0.095 | 0.94 | 0.07 | 0.024 | 0.92 | 4.46 | 0.012 | 0.28 |
| $C_2 + C_2=$ | 0.77 | 3.15 | 3.12 | 0.06 | 1.814 | 3.42 | 0.22 | 0.47 | 0.11 | 0.14 | 0.072 | 0.20 |
| $C_3$ | 0.08 | 6.07 | 4.14 | 0.24 | 5.40 | 3.75 | 0.04 | 3.81 | 3.52 | 0.08 | 0.53 | 0.97 |
| $C_3=$ | 0.48 | 12.91 | 18.47 | 0.06 | 8.57 | 15.82 | 0.09 | 4.22 | 9.88 | 0.19 | 0.53 | 2.08 |
| I—$C_4$ | 0.08 | 1.53 | 1.99 | 0.34 | 1.13 | 1.89 | 0.08 | 1.45 | 2.75 | 0.08 | 0.22 | 0.64 |
| N—$C_4$ | 0.22 | 3.72 | 1.79 | 0.05 | 1.71 | 1.63 | 0.04 | 3.08 | 2.15 | 0.09 | 0.47 | 0.59 |
| $C_4$='S | 2.97 | 13.11 | 12.19 | 0.49 | 15.89 | 12.80 | 0.25 | 7.87 | 8.82 | 0.32 | 2.49 | 1.88 |
| $C_5$'S | 6.35 | 8.72 | 11.27 | 0.33 | 10.44 | 12.10 | 0.48 | 19.70 | 12.30 | 0.40 | 14.21 | 2.85 |
| $C_6$'S | 1.40 | 4.15 | 6.34 | — | 5.61 | 8.71 | — | 4.43 | 8.74 | — | 3.47 | 7.81 |
| $C_7$'S | — | 3.12 | 5.01 | — | 2.85 | 3.54 | — | 0.95 | 4.13 | — | 1.93 | 1.48 |
| $C_8$'S | — | 2.97 | 5.62 | — | 2.87 | 4.10 | — | 2.20 | 2.17 | — | 1.25 | 0.89 |
| $C_9$'S | — | 2.83 | 4.35 | — | 2.78 | 3.15 | — | 2.26 | 4.14 | — | 0.91 | 0.55 |
| $C_{10}$'S | — | 1.19 | 1.79 | — | 1.20 | 1.54 | — | 1.07 | 0.94 | — | 0.78 | 0.48 |
| $C_{11}$'S | — | 0.19 | 0.24 | — | 0.21 | 0.21 | — | 0.63 | 0.52 | — | 0.56 | 0.43 |
| $C_{12}$'S | — | 0.14 | 0.20 | — | — | 0.21 | — | — | 0.41 | — | 0.51 | 0.31 |
| $C_{13}$'S | — | 0.83 | 1.07 | — | 0.95 | 1.13 | — | 0.33 | 0.59 | — | 0.36 | 0.31 |
| $C_{14}$'S | 0.19 | 1.13 | 0.15 | — | 1.15 | 0.20 | — | 0.22 | 0.83 | — | 0.26 | 0.18 |
| $C_{15}$'S | 0.63 | 0.26 | 0.39 | — | 0.26 | 0.30 | — | 0.68 | 0.40 | — | 0.36 | 2.10 |
| Hexadecane | 86.11 | 33.81 | 5.58 | — | 37.07 | 6.72 | 98.73 | 45.91 | 25.20 | — | 64.46 | 58.63 |
| Higher Boilers | 0.53 | — | 0.43 | — | — | 0.76 | — | 0.69 | — | — | 1.62 | — |
| Conversion of $C_{16}H_{34}$ | 13.89 | 66.19 | 92.02 | — | 62.93 | 91.60 | 1.27 | 54.09 | 69.50 | — | 35.54 | 26.71 |
| % HC From MEOH | — | — | 4.90 | 2.26 | — | 2.92 | — | — | 8.52 | 5.76 | — | 2.63 |
| Conversion of MEOH | — | — | 100 | 54.03 | — | 100 | — | — | 100 | 17.50 | — | 49.20 |

*Mix: All n-$C_{16}H_{34}$:MEOH Mixtures are 80 wt. % n-$C_{16}H_{34}$ and 20 wt. % MEOH

TABLE 3

THERMODYNAMIC ANALYSIS OF MEOH - HEXADECANE DISPERSED CATALYST RUNS

| | FEED | | PRODUCT | | | | | QMEOH | Qn-$C_{16}H_{34}$ |
|---|---|---|---|---|---|---|---|---|---|
| Run No. | g MEOH | g $C_{16}H_{34}$ | g $C_{16}H_{34}$ | g MEOH | g DME | g $H_2O$ | g MEOH HC* | kcal/mole | kcal/mole |
| 16 | 100 | — | — | 45.97 | 31.57 | 13.50 | 2.26 | −4.07 | — |
| 17 | — | 100 | 37.07 | — | — | — | — | — | +13.33 |
| 18 | 20 | 80 | 6.72 | — | 9.83 | 6.82 | 2.92 | −2.01 | +15.52 |
| 14 | — | 100 | 33.81 | — | — | — | — | — | +14.02 |
| 15 | 20 | 80 | 5.58 | — | 6.17 | 8.12 | 4.90 | −2.20 | +15.76 |

*Note: Remainder is CO and $CO_2$. MEOH conversion to CO and $CO_2$ is ignored in heat balance.
Q = Net heat liberated (−) or consumed (+) by each reactant For the uncatalyzed hexadecane reactions, the observed 50.1 kcal/mol and 46.5 kcal/mol activation energies fall close to the 50–60 kcal/mol range that is frequently cited for free radical cracking reactions of pure hydrocarbons. Similarly, for cracking runs using a catalyst-to-oil ratio of $2\times10^{-4}$, the measured activation energies of 20.5 kcal/mol and 23.6 kcal/mol fall within the 15 to 30 kcal/mol range that is often cited for the carbonium ion catalyzed reaction of other normal paraffins. That these measured activation energies are on the low side may be explained by the non-isothermality occurring at the entrance to the reactor where the feed is volatilized. The lower temperatures at the outsets of the reactions, where the catalyst is most active, would conceivably produce artificially low conversions and therefore artificially low activation energies if isothermality is assumed.

As the catalyst concentration was increased to a catalyst-to-oil ratio of $1\times10^{-2}$, the activation energy dropped to approximately 2.5 kcal/mol. Although such a drop in activation energy suggests the onset of a mass transfer limited regime, mathematically derived criteria which have been developed indicate that mass transfer limitations (both interphase and intracrystalline) should not be encountered under these reaction conditions.

In brief, these experimental runs 1–12, as shown in Table 1 and as analyzed in FIGS. 2–5, verify a theoretical model which was designed to predict the conditions required for cracking with low concentrations of a finely dispersed catalyst by applying the model to the cracking of hexadecane with dispersed ZSM-5B. At high conversons, the reaction becomes heat transfer limited because of the large cracking endotherm and the high intrinsic activity of the catalyst.

Figure 4:
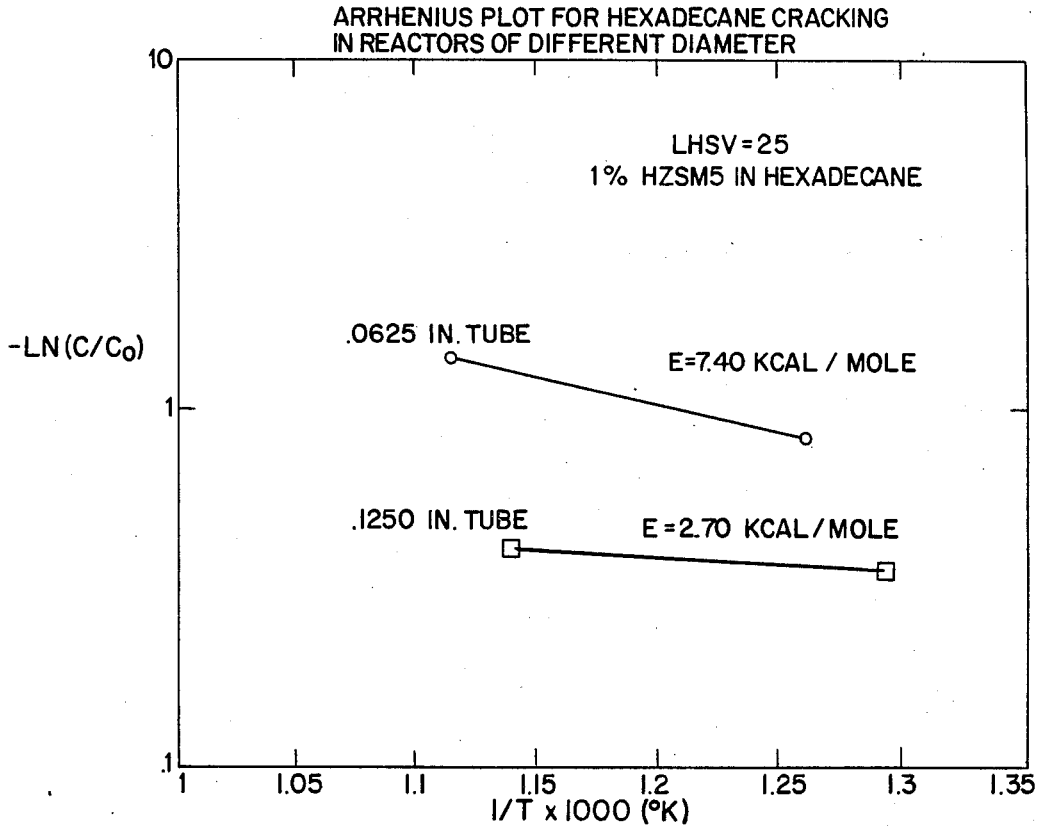
FIG. 4 is an Arrhenius plot for hexadecane cracking in reactors of different diameters.
Figure 5:
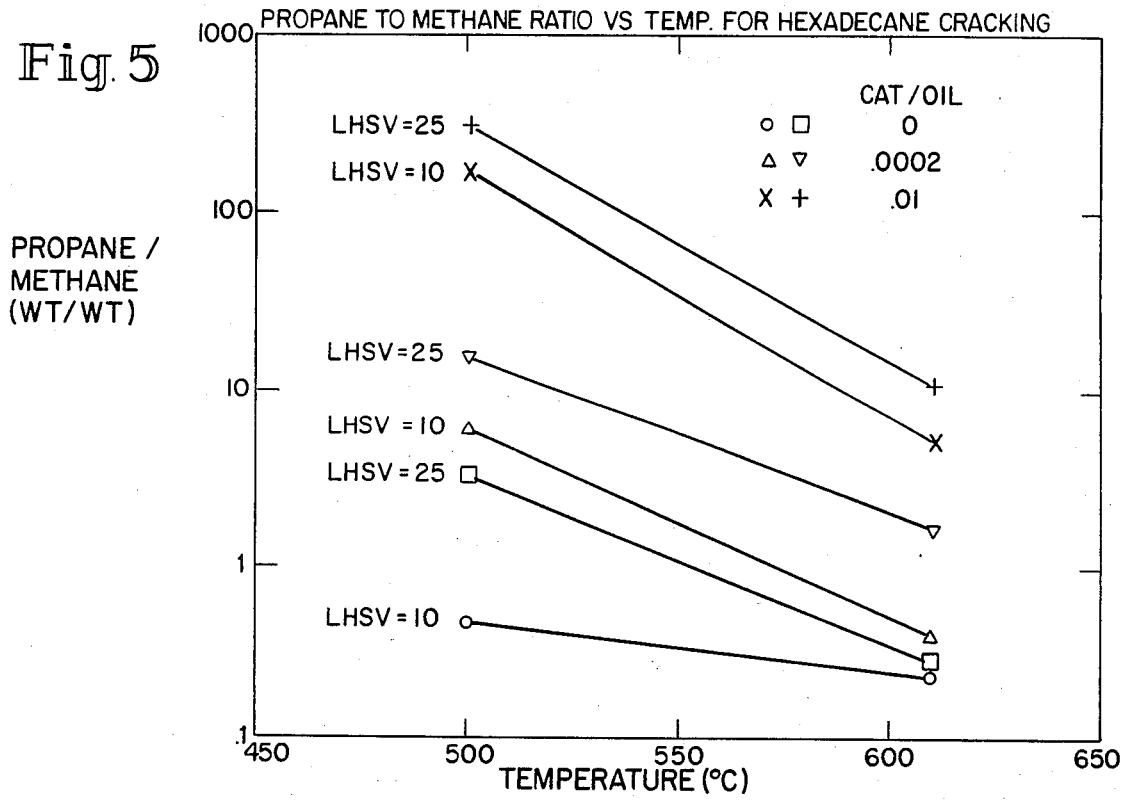
FIG. 5 is a graph for the ratio of propane/methane, on a weight basis, versus temperature for hexadecane cracking.

An important finding is that small quantities (approximately 0.02 wt. %) of a high activity ($\alpha$ at least 1600) small crystal ZSM-5B can produce significant levels of conversion when dispersed in a hydrocarbon stream fed to a riser-type reactor. The plot shown in FIG. 4 is particularly significant because it shows that operation in a smaller tube produces a higher surface area-to-volume ratio than a larger tube and therefore provides better heat transfer to the reaction from the heated exterior wall of the reactor.

Other conclusions are that nearly 50% of the n-hexadecane is converted by as little as 0.02 wt. % of catalyst ZSM-5B at 610° C. (1130° F.) and at a gas residence time of less than 1.5 seconds. No intracrystalline or interphase mass tranfer limitations were observed under these conditions. Another important conclusion is that the endothermic hexadecane cracking reaction becomes heat transfer limited as the concentration of the highly acidic ZSM-5B catalyst ($\alpha$ at least 1600) is increased to 1.0 wt. %.

EXAMPLE 2

Another series of 12 runs, numbers 13–24, was made to study the cracking behavior of hexadecane alone, the conversion behavior of methanol alone, and the conversion behavior of mixtures of hexadecane and methanol (80% n-$C_{16}$:20% $CH_3OH$ with the same catalyst used in runs 1–12 while furnishing information on the heat balance between the two reactions at four selected temperatures and at an LHSV of 18.6. These runs were carried out in an empty tubular reactor immersed in a heated isothermal fluidized sand bath.

The data for Runs 13–24 are summarized in Table 2 and are particularly interesting for the detailed product analyses With respect to LHSV, these runs 13–24 were therefore between the high LHSV runs 1, 2, 5, 6, 9, 10, and the low LHSV runs 3, 4, 7, 8, 11, and 12. Runs 13 and 19 used no catalyst and are therefore similar in this respect to runs 9–12. Runs 15, 18, 21, and 24 were heat-balance runs at each of the four temperatures for a feed mixture of 80% n-hexadecane and 20% methanol by weight. The two runs 15 and 18 at higher temperatures, 1125° F. (607° C.) and 1090° F. (588° C.), respectively, show that the conversion of hexadecane to substantially lower boiling materials was excellent while producing negligible quantities of methane.

These runs with a feed mixture of hexadecane and methanol are also interesting because they show that all methanol was converted at least to dimethyl ether (DME) and that most of the DME was broken down into methane and water, thereby liberating a significant amount of heat. It would also seem that the methane in these runs was then combined into more complex products such as propene for Runs 15 and 18 at higher temperatures of 1125° F. and 1090° F., respectively, with significant additions being made to the $C_{5's}$ and $C_{6's}$. For Run No. 15 at 1125° F., important additions were also made to the $C_{7's}$, $C_{8's}$, and $C_{9's}$, For the two runs at lower temperatures, Nos. 21 and 24, there was some additional production of propene over methanol alone and over hexadecane alone. Furthermore, for Run 21, additional amounts of $C_6+$ were produced.

It is further of interest that Run 15, in comparison to Run 16, produced less than $\frac{2}{3}$ as much water, presumably indicating that DME reacted to produce other products than methane and water. However, Run 18 snowed that lower temperatures produced even less water, particularly in contrast to the high production of water for Run 21 at 970° F., in comparison to the low production of water for Run 22 at the same temperature. These runs also show that the conversion of hexadecane was above 90% for the two higher temperatures and that the conversion of methanol was 100% for the three higher temperatures.

Figure 6:
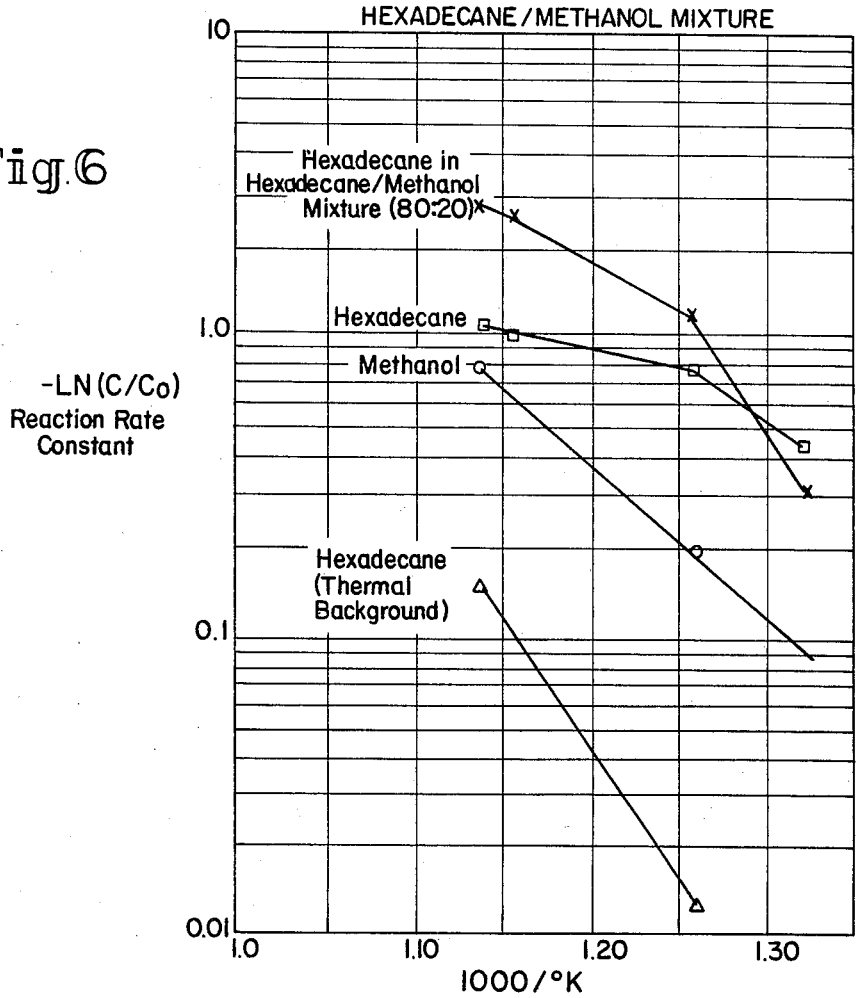
FIG. 6 is an Arrhenius plot for cracking of hexadecane and hexadecane/methanol mixtures.

The data in Table 2 are summarized in FIG. 6 which is an Arrhenius plot for cracking of hexadecane and hexadecane/methanol mixtures. This figure shows that methanol, when added to the hexadecane feed in the proportion of 20 wt. % methanol:80% n-hexadecane and subsequently mixed with high activity ZSM-5 catalysts (1% by weight on total feed), does increase the conversion of hexadecane above those conversion levels obtained with pure hexadecane as the feed and with pure methanol as the feed. At the lowest temperature (900° F.), methanol in the reaction products diluted the hexadecane and, because methanol's reaction rate is lower, reduced the hexadecane conversion below that achievable with pure hexadecane. The high conversion in the hexadecane-methanol mixture at higher temperatures is thus primarily due to the fact that the cracking reaction becomes reactor heat transfer limited. In consequence, the exothermic methanol reaction is able to contribute heat to the hexadecane reaction throughout the reaction zone and thereby maintain the reaction temperature uniformly at the selected level, not merely along heat transfer surfaces.

Table 3 is a thermodynamic analysis of the methanol:-hexadecane runs. This table shows that adding methanol to hexadecane drives the hexadecane reaction to a greater conversion to the extent that the net heat liberated by the methanol→DME→parafins+aromatics reaction is very nearly equivalent to the heat taken up in the now more extensive endothermic cracking reaction of the hexadecane.

Having generally described the process and its method of operation while co-reacting hydrocarbons such as gas oils with oxygenate such as methanol and having furnished specific exemplary supporting data, it is to be understood that no undue restrictions are to be imposed thereon except as defined by the following claims.

What is claimed:

1. A process for thermally sustaining an endothermal catalytic hydrocarbon cracking reaction without catalyst regeneration, said process comprising:

A. admixing a hydrocarbon, a carbon oxygenate, and a finely divided and highly active zeolite catalyst capable of cracking said hydrocarbon and exothermically converting said carbon oxygenate to a hydrocarbon of increased carbon content to form a feed mixture, within which said zeolite catalyst is dispersed, and feeding said mixture to a reaction zone; said zeolite catalyst provided in amounts of up to 5.0 wt. % of said hydrocarbon and having an $\alpha$ activity of at least 1600

B. heating said feed mixture to a reaction temperature at which said feed mixture is volatilized;

C. reacting said feed mixture within said reaction zone without substantial use of surface heat exchanging whereby said endothermic catalytic hydrocarbon cracking reaction is sustained substantially entirely by said exothermic catalytic carbon oxygenate conversion reaction; and D. withdrawing said catalyst and the combined reaction products of said cracking and conversion reactions from said reaction zone.

2. The process of claim 1, wherein said reaction zone is within a riser reactor.

3. The process of claim 1, wherein said hydrocarbon is a gas oil.

4. The process of claim 3, wherein said carbon oxygenate is selected from the group consisting of lower alochols, ethers, aldehydes, and ketones.

5. The process of claim 1, wherein said carbon oxygenate is methanol.

6. The process of claim 1, wherein said zeolite is HZSM-5B.

7. The process of claim 1, wherein said zeolite is used at 0.02 wt. % to 1.0 wt. % of said hydrocarbon.

8. The process of claim 7, wherein said reaction temperature is within the range of about 450°-650° C. (842°-1202° F.) and the liquid hourly space velocity is within the range of about 5 to about 35.

9. The process of claim 8, wherein said reaction temperature is about 600° C. (1112° F.) and said liquid hourly space velocity is about 25.

10. The process of claim 9, wherein said carbon oxygenate and said hydrocarbon are used in a ratio ranging from about 1:20 to about 2:1 by weight.

11. The process of claim 10, wherein said hydrocarbon is a gas oil and said carbon oxygenate is methanol.

12. The process of claim 11, wherein said carbon oxygenate and said catalyst are premixed, for dispersion of said catalyst in said carbon oxygenate, prior to admixing with said hydrocarbon.

* * * * *